US008276409B2

(12) United States Patent
Tooker

(10) Patent No.: US 8,276,409 B2
(45) Date of Patent: Oct. 2, 2012

(54) GLASS APPLIANCE COVER WITH BONDED HARDWARE

(75) Inventor: Troy F. Tooker, Allegan, MI (US)

(73) Assignee: Magna Mirrors of America, Inc., Holland, MI (US)

( * ) Notice: Subject to any disclaimer, the term of this patent is extended or adjusted under 35 U.S.C. 154(b) by 0 days.

(21) Appl. No.: 12/917,696

(22) Filed: Nov. 2, 2010

(65) Prior Publication Data

US 2011/0101838 A1 May 5, 2011

Related U.S. Application Data

(60) Provisional application No. 61/258,406, filed on Nov. 5, 2009.

(51) Int. Cl.
*D06F 29/00* (2006.01)

(52) U.S. Cl. ..... 68/196; 49/501

(58) Field of Classification Search ..... 49/381, 49/501; 68/196
See application file for complete search history.

(56) References Cited

U.S. PATENT DOCUMENTS

| | | | |
|---|---|---|---|
| 3,707,521 | A | 12/1972 | De Santis |
| 4,098,025 | A | 7/1978 | Stock et al. |
| 4,115,901 | A | 9/1978 | Schmidt |
| 4,167,088 | A | 9/1979 | Governale |
| 4,223,482 | A | 9/1980 | Barroero et al. |
| 4,248,489 | A | 2/1981 | Barroero et al. |
| 4,255,901 | A | 3/1981 | Stenberg |
| 4,363,191 | A | 12/1982 | Morgan |
| 4,392,330 | A | 7/1983 | Buhr |
| 4,443,973 | A | 4/1984 | Naka |
| 4,447,985 | A | 5/1984 | Weber et al. |
| 4,502,249 | A | 3/1985 | Banford |
| 4,512,124 | A | 4/1985 | Banford |
| 4,553,360 | A | 11/1985 | Colombo |
| 4,562,668 | A | 1/1986 | Karhu et al. |
| 4,566,222 | A | 1/1986 | Hatvany |
| 4,761,916 | A | 8/1988 | Sanok et al. |
| 4,799,730 | A | 1/1989 | Harasaki |
| 4,811,532 | A | 3/1989 | Fratti et al. |
| 4,826,239 | A | 5/1989 | Nishikawa et al. |
| 4,927,207 | A | 5/1990 | Kishino |
| 4,948,206 | A | 8/1990 | Fitzpatrick |
| 4,956,954 | A | 9/1990 | Horgan, Jr. |
| 4,962,615 | A | 10/1990 | Birdling |
| 5,076,637 | A | 12/1991 | Larkin et al. |
| 5,136,812 | A | 8/1992 | Voegele |
| 5,147,927 | A | 9/1992 | Baghdachi et al. |
| 5,187,837 | A | 2/1993 | Gunderson et al. |
| 5,187,897 | A | 2/1993 | Maidment |
| 5,193,308 | A | 3/1993 | Davidian |
| 5,205,072 | A | 4/1993 | Eutebach |
| 5,207,036 | A | 5/1993 | Sampson et al. |

(Continued)

*Primary Examiner* — Katherine W Mitchell
*Assistant Examiner* — Justin Rephann
(74) *Attorney, Agent, or Firm* — Gardner, Linn, Burkhart & Flory, LLP

(57) ABSTRACT

A cover assembly for an appliance includes a glass panel and at least one metallic attachment element bonded to an inner surface of the glass panel via a layer of cured adhesive. The at least one metallic element is configured for mounting to at least one corresponding structure of the appliance to mount the cover assembly at the appliance. The layer of cured adhesive bonds the at least one metallic element to the inner surface of the glass panel without exposure of the bonded element on an outer surface of the glass panel. A perimeter frame portion may be established around a perimeter region of the glass panel.

20 Claims, 5 Drawing Sheets

U.S. PATENT DOCUMENTS

| | | | | |
|---|---|---|---|---|
| 5,214,878 | A | 6/1993 | Watt | |
| 5,239,406 | A | 8/1993 | Lynam | |
| 5,331,784 | A | 7/1994 | Agrawal et al. | |
| 5,349,040 | A | 9/1994 | Trinks et al. | |
| 5,385,383 | A | 1/1995 | Kreis et al. | |
| 5,388,372 | A | 2/1995 | Zanoni | |
| 5,388,424 | A | 2/1995 | Chopko et al. | |
| 5,392,565 | A | 2/1995 | Rentschler | |
| 5,394,649 | A | 3/1995 | Lindgren et al. | |
| 5,419,085 | A | 5/1995 | Imbur | |
| 5,426,897 | A | 6/1995 | Gazaway | |
| 5,428,925 | A | 7/1995 | Snyder | |
| 5,428,968 | A | 7/1995 | Tetsukawa et al. | |
| 5,430,982 | A | 7/1995 | Bane | |
| 5,475,956 | A | 12/1995 | Agrawal et al. | |
| 5,483,771 | A | 1/1996 | Herbst | |
| 5,508,111 | A | 4/1996 | Schmucker | |
| 5,551,197 | A | 9/1996 | Repp et al. | |
| 5,680,245 | A | 10/1997 | Lynam | |
| 5,704,173 | A | 1/1998 | Repp et al. | |
| 5,853,895 | A | 12/1998 | Lewno | |
| 5,864,419 | A | 1/1999 | Lynam | |
| 5,966,874 | A | 10/1999 | Repp et al. | |
| 5,986,797 | A | 11/1999 | Lynam | |
| 6,068,719 | A | 5/2000 | Lewno | |
| 6,122,093 | A | 9/2000 | Lynam | |
| 6,128,860 | A | 10/2000 | Repp et al. | |
| 6,298,606 | B1 | 10/2001 | Repp et al. | |
| 6,319,344 | B1 | 11/2001 | Lewno | |
| 6,665,984 | B2 * | 12/2003 | Bienick et al. | 49/501 |
| 6,766,596 | B1 * | 7/2004 | Bienick et al. | 34/601 |
| 6,819,467 | B2 | 11/2004 | Lynam | |
| 6,846,039 | B2 | 1/2005 | Lewno | |
| 6,871,450 | B2 | 3/2005 | Repp et al. | |
| 7,032,350 | B2 * | 4/2006 | Bienick et al. | 49/501 |
| 7,332,225 | B2 | 2/2008 | Lewno | |
| 7,360,338 | B2 | 4/2008 | Repp et al. | |
| 7,513,131 | B2 * | 4/2009 | Kim | 68/13 R |
| 7,614,162 | B2 * | 11/2009 | Renzo | 34/603 |
| 2004/0020246 | A1 * | 2/2004 | Yun et al. | 68/24 |
| 2006/0265959 | A1 * | 11/2006 | Renzo | 49/381 |
| 2009/0229320 | A1 * | 9/2009 | Yoo et al. | 68/3 R |
| 2009/0320371 | A1 * | 12/2009 | Hill et al. | 49/13 |
| 2010/0107497 | A1 | 5/2010 | Hulst | |

* cited by examiner

GLASS APPLIANCE COVER WITH BONDED HARDWARE

CROSS REFERENCE TO RELATED APPLICATION

The present application claims the benefit of U.S. provisional application Ser. No. 61/258,406, filed Nov. 5, 2009, which is hereby incorporated herein by reference in its entirety.

FIELD OF THE INVENTION

The present invention relates generally to doors or covers or panels for appliances, such as for washing machines and the like.

BACKGROUND OF THE INVENTION

Conventional appliances, such as washing machines and dryers and the like, typically comprise a metal housing or casing with a metal door hingedly attached to the casing via one or more hinge elements fastened to the door and casing, such as via fasteners. It is known to provide a glass panel, such as for a front loading washing machine or the like, with the glass panel having a metal frame or encasement around its periphery and with the metal frame hingedly attached to the casing, such as via a hinge element fastened to the frame and casing, such as via fasteners.

SUMMARY OF THE INVENTION

The present invention provides a lid or cover or door assembly for an appliance (such as a washing machine or dryer or the like), with the lid or cover or door assembly comprising a glass panel or lid or cover panel and at least one hardware element, such as a hinge attachment element and/or a latch element single-sided bonded to the glass panel so that the hardware element or elements are not exposed on an opposite or outside surface of the glass panel. The cover assembly may include an encapsulation or perimeter frame molded or adhered or bonded at and around the perimeter edge region of the glass panel, and/or may include an opaque layer around the perimeter edge region of the glass panel (such as a frit layer or the like) and along the bonded region of the hardware elements to provide an enhanced appearance to the cover assembly.

According to an aspect of the present invention, a cover assembly for use on an appliance, such as a washing machine (such as a top loading washing machine or dryer or a front loading washing machine or dryer the like) includes a glass cover or lid or panel having an outer surface and an inner surface and a perimeter region. At least one metallic hardware element or metallic attachment element is bonded to the inner surface of the glass panel via a layer of cured adhesive. The hardware or attachment element or elements may comprise a hinge attachment element for attaching to a corresponding hinge element or structure at the appliance and/or a latch or latching element for latching the glass panel in its closed position at the appliance.

A perimeter frame portion or encapsulation may be established along and around the perimeter edge region of the glass panel. Optionally, the encapsulation may be molded over and around the perimeter edge region of the glass panel or may be bonded along the perimeter edge region of the glass panel. Optionally, the encapsulation may encompass the perimeter region of the inner surface of the glass panel and the perimeter edges of the glass panel, with the outer surface of the glass panel being exposed.

Therefore, the present invention provides a substantially transparent glass lid or cover panel for an appliance, with the glass panel having a metallic hardware element and/or a perimeter frame adhesively bonded along its perimeter regions so as to limit or avoid exposure of the bonded hardware element at an outer or opposite surface of the glass panel. The glass panel may have an opaque coating or layer, such as a ceramic frit layer or the like, along its perimeter region and in the bonding area at or near or along the perimeter region to conceal the hardware elements so that the bonded hardware elements are not readily discernible and viewable through the substantially transparent glass panel.

These and other objects, advantages, purposes and features of the present invention will become apparent upon review of the following specification in conjunction with the drawings.

DESCRIPTION OF THE PREFERRED EMBODIMENTS

Figure 1:
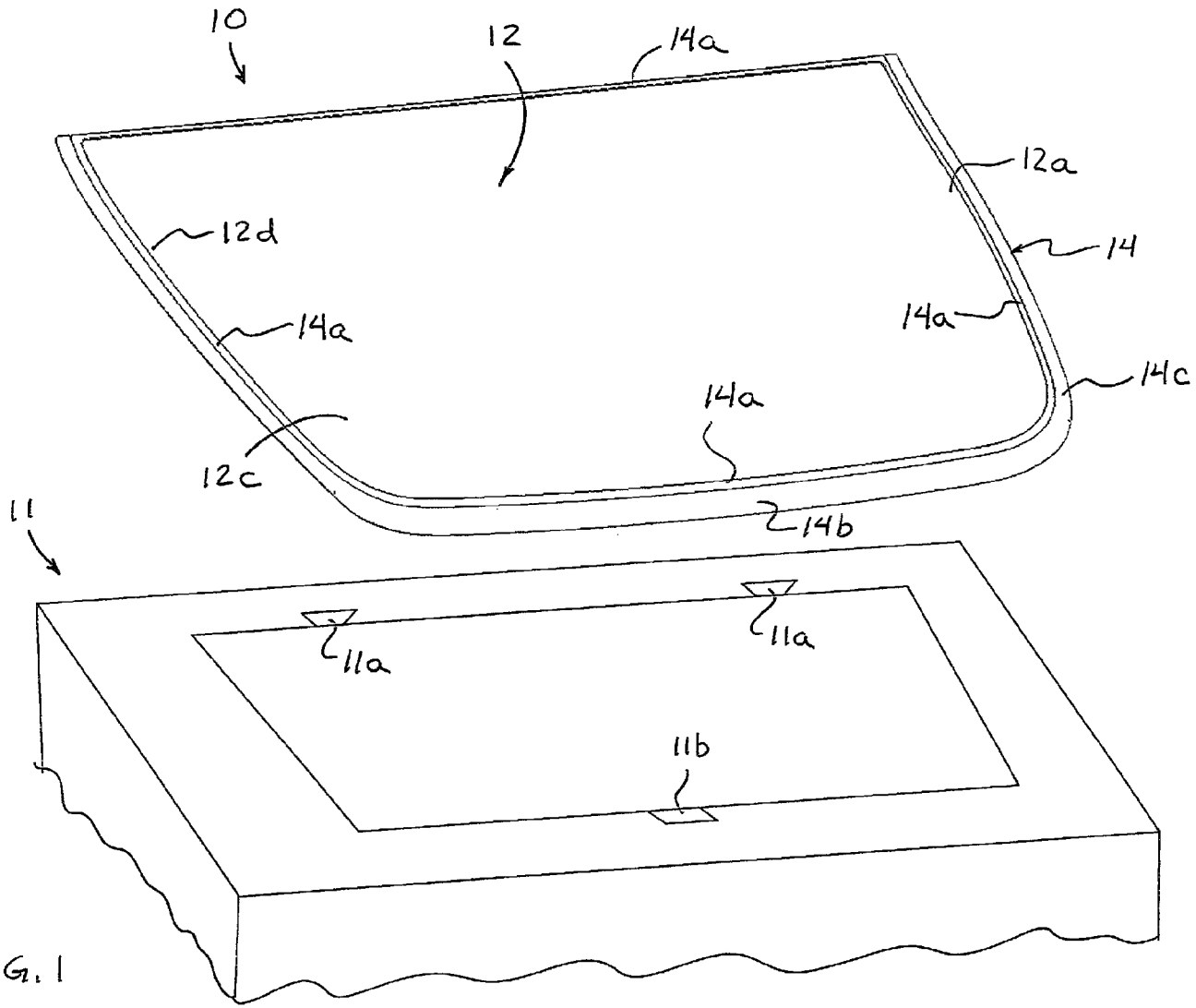
FIG. 1 is an exploded upper perspective view of an appliance and cover assembly in accordance with the present invention.
Figure 2:
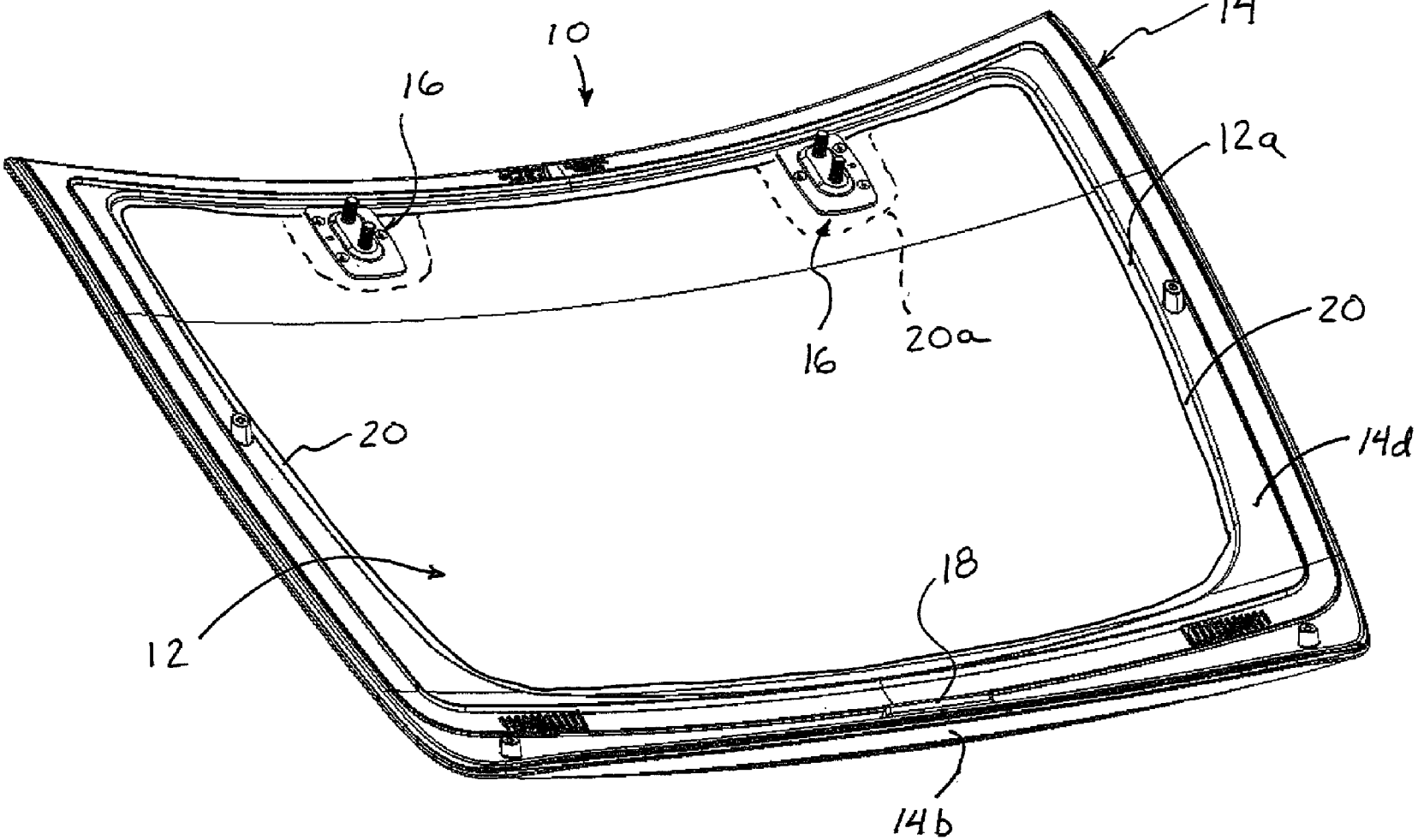
FIG. 2 is an underside perspective view of the cover assembly of FIG. 1.
Figure 3:
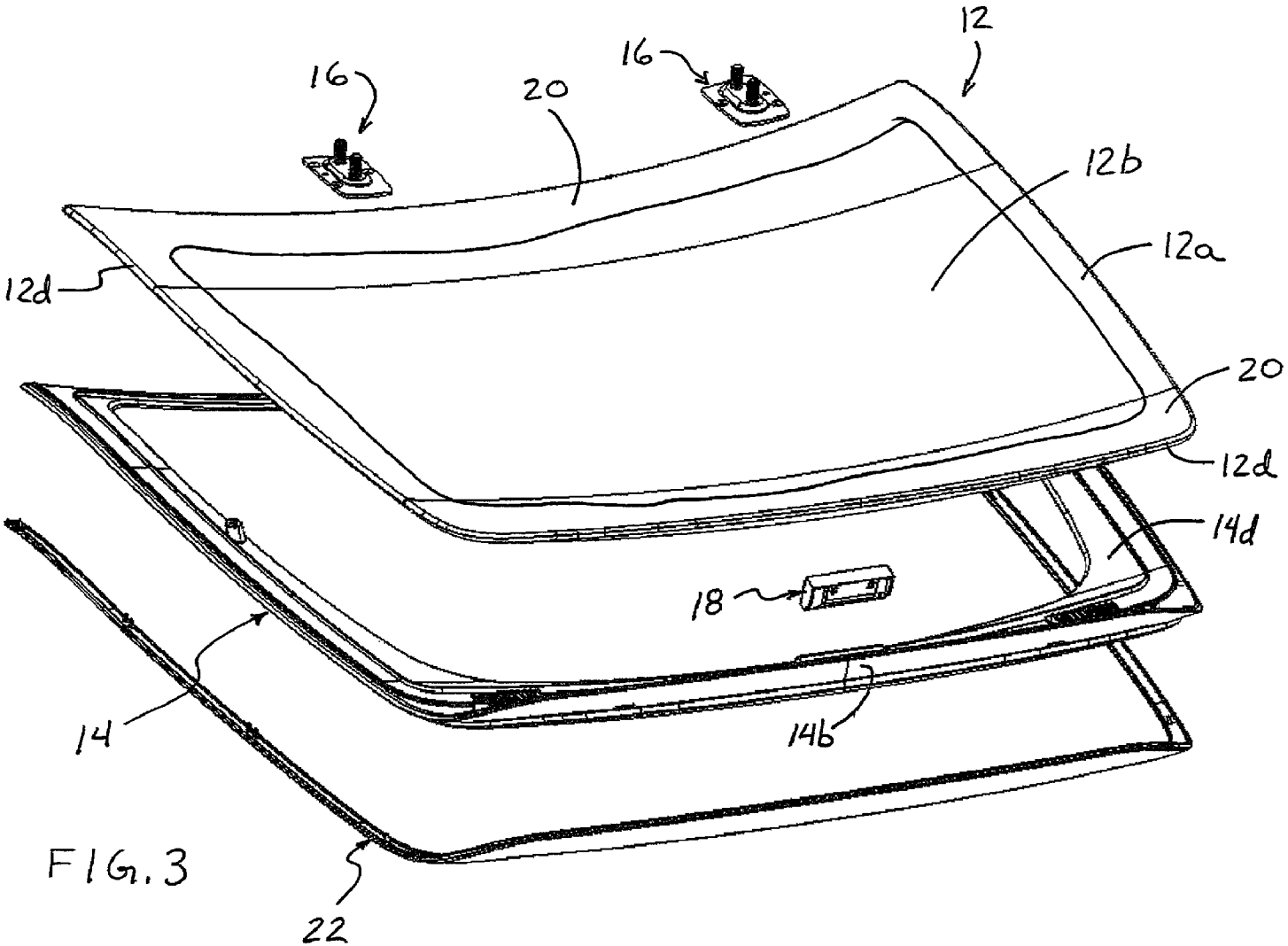
FIG. 3 is an exploded perspective view of the cover assembly of FIG. 2.

Referring now to the drawings and the illustrative embodiments depicted therein, a cover assembly 10 for an appliance 11, such as a top loading washing machine or dryer or a front loading washing machine or dryer the like, includes a substantially transparent glass lid or cover panel 12 that has a perimeter frame portion or encapsulation 14 established at least partially along the perimeter regions 12*a* of glass panel 12 (FIGS. 1-3). At least one metallic hardware element or mounting hardware is bonded to an interior or inner surface 12*b* of the glass panel 12 and thus, when viewed from the outside of the cover or lid, the bonded hardware is not exposed at the outer surface of the glass panel. The mounting hardware includes one or more hinge attachment elements or plates or brackets 16 and may include a latch element 18. The mounting hardware and/or perimeter frame portion may be assembled to the hardware bonded glass panel and/or molded over the perimeter regions of the glass panel to create the finished product.

In the illustrated embodiment, the glass panel or cover 12 comprises a generally planar (or curved or non-planar depending on its application) panel that is formed to fit at or in or over a recess and opening of its associated appliance. As shown in FIGS. 1-3, glass panel 12 may comprise a generally rectangular-shaped cover or lid with rounded front corners, but may comprise other shapes depending on the particular application of the cover assembly and appliance. The glass panel 12 has an inner surface 12*b* and an outer surface 12*c* and perimeter edges 12*d*, and may include an opaque coating or frit layer 20 (discussed below) at its surface (and generally along the perimeter regions 12*a*) to conceal or render covert the presence of the portion of the frame that is at the inner surface 12*b* of the glass panel and/or the hinge attachment brackets 16 and latch element 18 when the cover assembly is closed and is viewed from outside the appliance. Glass panel 12 may comprise any type of glass panel, and preferably comprises a substantially transparent strengthened glass panel, such as a tempered or toughened glass panel, suitable for use as a door or cover panel or lid for an appliance such as a washing machine or dryer.

Figure 1A:
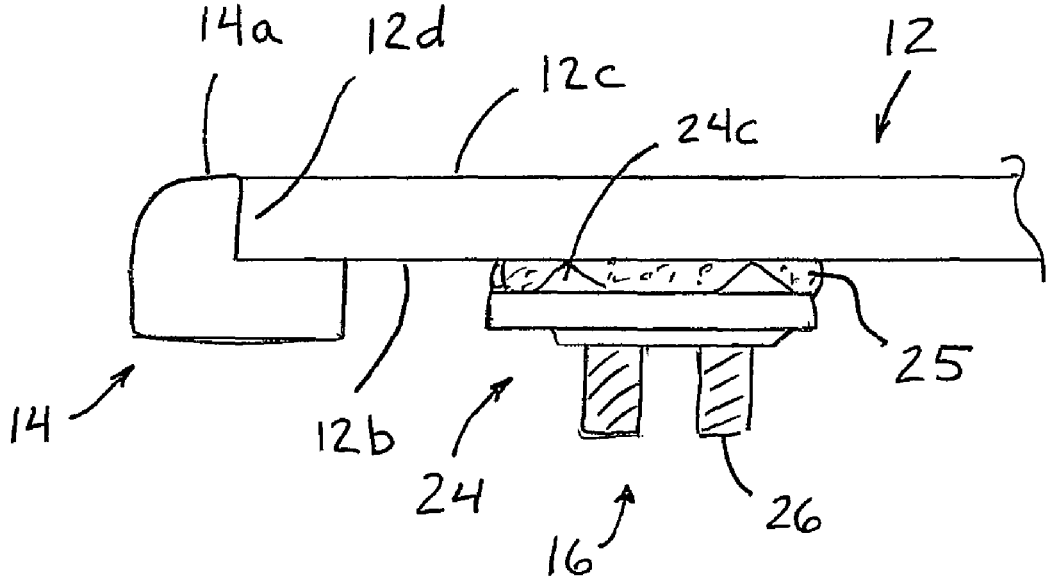
FIG. 1A is a sectional view of the cover assembly of FIG. 1, showing the frame and hinge bracket as attached at or near a perimeter region of the cover panel.

The perimeter frame portion 14 of the cover assembly 10 encompasses the perimeter edges 12*d* of glass panel 12 and overlaps the perimeter regions 12*a* of glass panel 12 at the inner surface 12*b* of glass panel 12, and the hinge attachment brackets 16 may be disposed inboard of the perimeter frame portion. Perimeter frame portion 14 provides a plastic or polymeric encapsulation (such as a flexible PVC encapsulation or the like) along and around the perimeter regions 12*a* of the inner surface 12*b* and along and around the perimeter edges 12*d* of glass panel 12, and may not encompass or overlap the perimeter regions of the outer surface 12*c* of glass panel. Thus, and as best shown in FIG. 1A, the glass panel 12 may be received in or supported in the perimeter frame portion such that the entire outer surface 12*c* of the glass panel 12 may be viewable or exposed, with no perimeter frame or other covering at or on the outer surface of the glass panel 12. The frame portion 14 may include an upper surface 14*a* that is generally flush or generally co-planar with the upper or outer surface 12*c* of the glass panel. As can be seen in FIG. 3, frame portion 14 includes a forward lip or grasping portion 14*b* that protrudes forwardly and/or downwardly from the forward edge of glass panel 12 to allow the user of the appliance to grasp the forward edge region of the cover assembly to open and close the cover of the appliance.

The frame portion 14 may be molded over and around the perimeter edges and perimeter regions of the inner surface of the glass panel so as to receive or encompass the perimeter edges and to secure the frame portion at the perimeter edges of the glass panel. For example, the glass panel 12 may have the hardware elements bonded to its inner surface and then may be placed in a mold cavity, where the perimeter frame or encapsulation is molded over (such as via injection molding or the like) and around and along the perimeter edge regions of the glass panel to encapsulate the perimeter edges of the glass panel. Optionally, the frame portion may be adhesively bonded to the perimeter edges of the glass panel and may be bonded at the inner surface of the glass panel (and optionally may overlap or encompass the outer surface of the glass panel and may be bonded at the inner surface of the glass panel).

Optionally, and as shown in FIG. 3, a trim element or bezel 22 may be disposed at an outer surface 14*c* of frame portion 14 to provide the desired appearance to the cover assembly. The bezel 22 may be adhered or otherwise attached (such as via a snap attachment or the like) to the outer or upper surface 14*c* of frame portion 14 and along the side and forward perimeter regions of the cover panel, such as shown in FIG. 3. Optionally, for example, the bezel 22 may comprise a chrome strip or a colored strip or the like to provide an enhanced appearance to the cover assembly and appliance.

Figure 5:
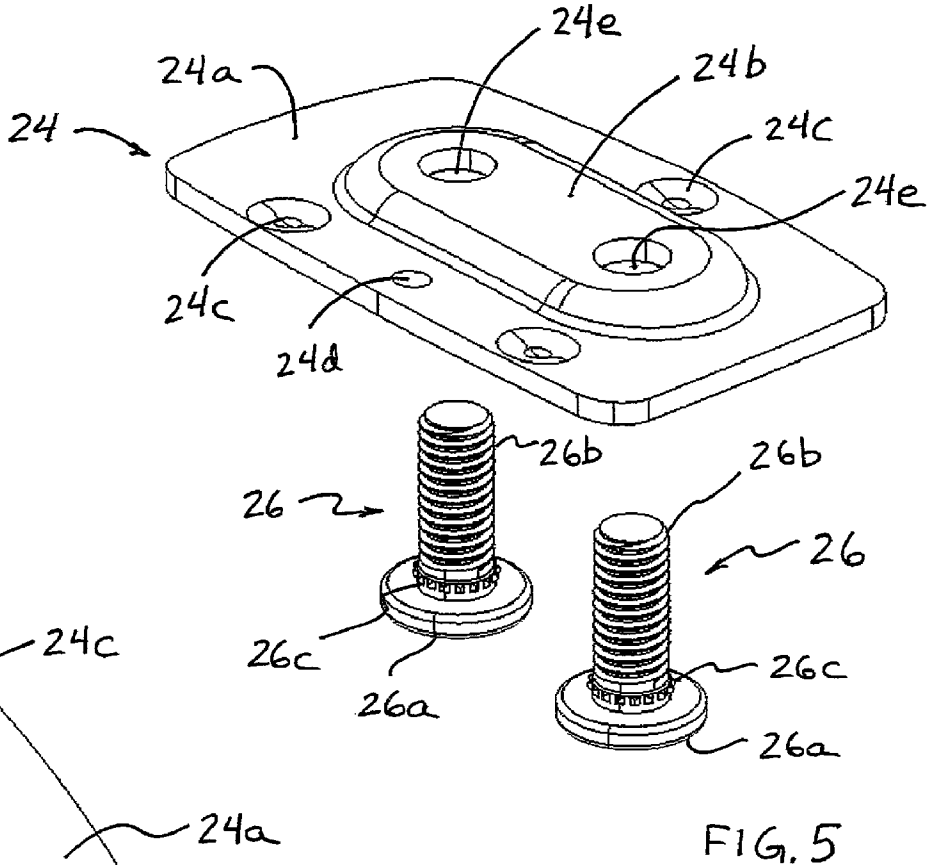
FIG. 5 is an exploded perspective view of the hinge mounting bracket of FIG. 4.
Figure 4:
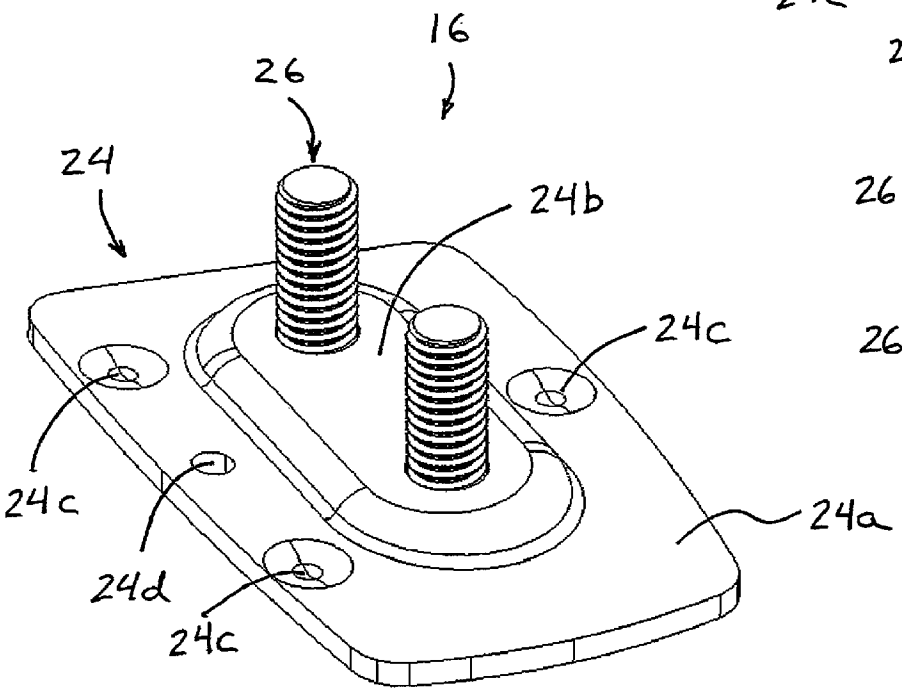
FIG. 4 is a perspective view of a hinge mounting bracket of the cover assembly of FIGS. 1-3.

In the illustrated embodiment, cover assembly 10 includes a pair of hinge attachment elements or brackets 16 adhesively bonded at and spaced apart along the perimeter region of the inner or lower surface 12*b* of glass panel 12. The hinge attachment elements or brackets 16 are configured to attach to one or more hinge structures 11*a* (FIG. 1) of the appliance 11 (such as flexible brackets or pivotable brackets or hinges or the like) to attach the cover assembly at the appliance 11. As best shown in FIGS. 4 and 5, each hinge attachment bracket 16 includes a base plate 24 and a pair of fasteners or bolts or studs 26 that protrude from base plate 24 for fastening or attaching to a hinge element of the appliance. Base plate 24 comprises a mounting flange 24*a* and a raised bolt mounting portion 24*b*. Mounting flange 24*a* comprises a generally planar plate or flange around the bolt mounting portion 24*b*, with a plurality of projections or protrusions or standoffs 24*c* (such as three or more non-linearly arranged standoffs or embossments disposed inboard of the perimeter edges of the mounting flange) protruding therefrom for spacing the bonding surface of the mounting flange 24*a* from the glass surface 12*b* for establishing the desired or appropriate bond line thickness of the layer of adhesive 25 (FIG. 1A) that bonds the base plate 24 to the glass panel 12. Base plate 24 of hinge attachment bracket 16 may comprise any suitable material, such as a metallic material (such as steel, such as 1008/1010 cold rolled steel, and optionally such as E-coated steel that is E-coated with a cathodic electro deposition epoxy resin zinc phosphate or the like) or the like. Optionally, base plate may include a racking hole or aperture 24*d* to assist in holding or racking the base plate during the E-coat process and/or other coating or painting processes.

Bolt mounting portion 24*b* of base plate 24 includes one or more apertures 24*e* for receiving a respective fastener 26, such as a bolt or the like, for attaching a hinge element to the hinge attachment bracket 16. The fastener 26 includes a head portion 26*a* and a threaded shaft 26*b* (for threadedly attaching to a hinge element of the appliance). The fastener 26 may be press fit through the aperture 24*e* (and the fastener 26 may include a knurled or roughened surface 26*c* at the base of its threaded shaft 26*b* and at or near the head 26*a* of the fastener) to limit rotation of the fastener relative to the hinge attachment bracket when the fastener is received through aperture or hole 24*e* and when the hinge attachment bracket 16 is adhesively bonded to the glass panel 12. The gap between the glass surface 12*b* and the inner surface of the raised bolt mounting portion 24*b* of base plate 24 when the base plate is adhesively bonded to the glass surface provides clearance for the bolt head 26*a* to fit therein, and the bolt head 26*a* may engage the glass surface, whereby the glass surface may limit or substantially preclude movement of the bolt or fastener inwards towards the glass panel when the hinge attachment bracket 16 is adhesively bonded to the glass surface 12*b* of the glass panel 12.

In the illustrated embodiment, cover assembly 10 includes a latch element 18 adhesively bonded to the inner glass surface 12*b* of glass panel 12 for engaging a corresponding latch element 11*b* (FIG. 1) at the appliance 11 to retain the cover panel in its closed position when the cover assembly is normally mounted at the appliance and to limit or resist unintentional opening of the cover panel during use of the appliance. Latch element 18 may comprise any suitable latch element, and may comprise a metallic tab that flexes when it engages a corresponding slot or tab at the appliance to secure the cover panel in its closed position. Latch element 18 may be adhesively bonded at glass surface 12*b* and may include an attaching or bonding surface with a plurality of projections extending therefrom, such as in a similar manner as base plate 24, discussed above. Optionally, the latch element may be attached or secured to or received in or incorporated in or integrally formed or molded with the perimeter frame portion or encapsulation 14, depending on the particular application of the cover assembly.

Optionally, the perimeter regions of the interior surface of the glass panel 12 may have a non-transparent or opaque coating or frit layer 20 or paint or ink or the like disposed thereon, so as to substantially conceal the portion 14*d* (FIG. 3) of the frame 14 that is disposed at and along the inner surface of the glass panel and/or the hinge attachment brackets 16 and/or latch element 18 and limit viewing of the inner portion of the frame and the bonded hardware elements and adhesive through the glass panel from the exterior side of the glass panel. As shown in FIG. 2, the fit layer 20 may be disposed along the perimeter region 12*a* of the glass panel to conceal or render covert the inner portions of the frame, and a frit layer portion 20*a* may be disposed at the mounting areas of the hinge attachment brackets 16 to conceal or render cover the bonded hardware elements that are bonded to the inner surface of the glass panel inboard of the frit coated perimeter regions. Optionally, the frit layer 20 may be wide enough to encompass the hardware bonding areas to provide a more uniform width band along the rear or hinged portion of the glass panel.

Optionally, the frit or paint or ink layer or coating may be disposed or screened onto the surface 12*b* of the glass panel after forming the glass panel. In applications where an opaque or non-transparent frit layer or other pattern or the like may be disposed at the surface of the glass panel, the adhesive may comprise a substantially non-transparent adhesive. The opaque layer or fit layer may comprise a ceramic fit layer and may function to facilitate adhering or bonding of the hardware elements and/or perimeter frame to the glass panel. The frit layer may be substantially opaque, and thus may improve the overall appearance of the cover assembly, since the bonding surfaces are not readily discernible or viewable through the glass panel and the frit layer. Examples of such frit layers are described in U.S. Pat. Nos. 7,360,338; 7,332,225; 6,871,450; 6,846,039; 6,319,344; 6,298,606; 6,128,860; 6,068,719; 5,966,874; 5,853,895; 5,704,173; and 5,551,197, which are hereby incorporated herein by reference in their entireties. The fit layer may comprise a black or substantially opaque layer, or may comprise a white layer or other color as desired, such as to match a color scheme of the perimeter frame or appliance at which the cover assembly is mounted. The frit layer may be disposed onto the surface of the glass panel in any desired pattern, such as stripes, dots, wave pattern or the like, to provide the desired appearance to the cover or lid, depending on the particular application of the cover assembly.

Optionally, the frit layer 20 may be disposed or deposited on and bonded to the surface of glass panel 12 as an opaque fit layer or coating covering and concealing a region of the surface from a peripheral edge region 12*a* of the glass panel inward a desired or appropriate amount, so as to establish a border coating around the perimeter of the glass panel (such as via an opaque or light absorbing coating or layer that renders the glass panel substantially or entirely non transmitting of visible light such that essentially no visible light passes therethrough). Glass panel 12, which may be initially in an unstrengthened or untempered condition after cutting and sizing to its desired shape, can be painted, such as by screen coating or other techniques, with a coating of ceramic paint on its inner surface and along the perimeter regions thereof. Thereafter, glass panel 12 may be heated, followed by strengthening, such as tempering, to strengthen the glass. Such heating and tempering operations cause the ceramic paint to become fused to the surface of the glass panel. Thus, although starting as a layer of paint containing ceramic particles and pigment, the coating ends up as a thin frit layer of ceramic material, which is fused to the surface of the glass panel. Since the ceramic fit coating includes a pigment of a desired color (such as a color that matches or substantially matches the color of the perimeter frame or encapsulation), the layer results in a permanent surface coloration of the glass panel, However, the bonded hardware elements and/or perimeter frame may optionally be bonded to the surface of the glass panel without any frit layer on the glass surface, depending on the particular application and desired appearance of the cover assembly and appliance.

Thus, cover assembly 10 may include metallic hinge attachment brackets 16 and optionally a metallic latch element 18 bonded to the glass surface 12*b* of glass panel 12 and a plastic or polymeric frame portion 14 molded over and/or bonded to the glass surface of glass panel 12. The metallic hardware elements may be bonded to the glass surface via any suitable adhesive or bonding means (for example, and preferably, a rapid cure, rapid set BETAMATE® two part urethane adhesive), such as via curing of a bonding or adhesive material and utilizing bonding processes of the types described in U.S. Pat. Nos. 7,360,338; 7,332,225; 6,871,450; 6,846,039; 6,319,344; 6,298,606; 6,128,860; 6,068,719; 5,966,874; 5,853,895; 5,704,173; and/or 5,551,197, which are hereby incorporated herein by reference in their entireties. Optionally, the metallic hardware may be bonded to the glass surface via a two component urethane adhesive, such as by utilizing aspects of the bonding processes described in U.S. Pat. Nos. 7,332,225; 6,846,039; 6,319,344; 6,068,719; and 5,853,895, which are hereby incorporated herein by reference in their entireties (such as a two component urethane adhesive having an isocyanate component and a polyol component with the polyol component including at least one plural amine compound). Optionally, an adhesion promoting primer may be disposed at the metallic hardware and/or the glass surface prior to joining the hardware to the glass surface, such as by utilizing aspects of the bonding processes described in the above incorporated U.S. patents.

Likewise, the plastic or polymeric perimeter frame 14 may be molded over the glass panel 12 via any suitable molding techniques or may be bonded to the glass panel via any suitable adhesive, such as via curing of a bonding or adhesive material and utilizing bonding processes of the types described in U.S. Pat. Nos. 7,360,338; 7,332,225; 6,871,450; 6,846,039; 6,319,344; 6,298,606; 6,128,860; 6,068,719; 5,966,874; 5,853,895; 5,704,173; and/or 5,551,197, which are hereby incorporated herein by reference in their entireties. Optionally, the plastic frame may be bonded to the glass surface via a one component urethane adhesive, such as by utilizing aspects of the bonding processes described in U.S. Pat. Nos. 7,360,338; 6,871,450; 6,298,606; 6,128,860; 5,966,874; 5,704,173; and/or 5,551,197, which are hereby incorporated herein by reference in their entireties. Optionally, an adhesion promoting primer may be disposed at the frame portion and/or the glass surface prior to joining the frame portion to the glass surface, such as by utilizing aspects of the bonding processes described in the above incorporated U.S. patents.

Optionally, and such as shown in the illustrated embodiment, the glass panel may include frit layer 20 established along the inner surface and along the perimeter regions of the glass panel to substantially conceal the bonded hardware and/or frame portions along the perimeter regions so that the hardware and/or frame portions are not readily viewable through the glass panel from outside the glass panel or cover or lid. Optionally, however, the glass panel may not include a frit layer, and the hardware and frame portion may be bonded directly to the inner surface of the glass panel. Optionally, the hardware and frame portion may be bonded to the glass panel via other suitable adhesives, such as via a UV cured adhesive or the other type of cured adhesive or bonding adhesive or the like, while remaining within the spirit and scope of the present invention. Optionally, the bonding adhesive may be selected from a number of adhesive types or classes including moisture-activated urethanes, such as described in U.S. Pat. No. 3,707,521, which is hereby incorporated herein by reference in its entirety, moisture-activated silicones, moisture-curable activated urethanes, chemically-activated adhesives, and thermally-activated adhesives, and/or the like. Other adhesives, such as aerobically-cured, anaerobically-cured, and radiation-cured adhesives can also be used, without affecting the scope of the present invention. When cured, the bond-line thickness may be in the range of about 1 micron to 10 mm, preferably about 5 microns to 5 mm, and most preferably about 25 microns to 1 mm, such as, for example, on the order of about 1 mm (with the preferred bond-line thickness for the bonded hardware and adhesive used thereat being established by the projections or standoffs of the mounting flanges). The adhesive may be a moisture-activated adhesive, a chemically activated adhesive, a heat or radiation or ultraviolet or microwave radiation activated adhesive or the like, and the glass panel and hardware or frame portions may be exposed to the appropriate conditions or elements or radiation to cure the adhesive and bond the hardware and frame portions to the glass panel, such as described in U.S. Pat. Nos. 6,298,606; 6,128,860; 5,966,874; 5,704,173; and 5,551,197; and 5,331,784, which are hereby incorporated herein by reference in their entireties.

Optionally, a temporary fixturing adhesive may also be provided, such as a hot-melt thermoplastic, which temporarily locates or fixtures the hardware and/or frame portion against the glass panel or frit layer, while the bonding adhesive cures and forms the permanent primary bond. The temporary fixturing adhesive may secure or hold the hardware and/or frame portion to the glass panel until the bonding process is complete and the bonding adhesive has cured and formed the permanent bond. Optionally, to improve and promote the bonding characteristics of the bonding adhesive, the glass surface (or fit layer if applicable) and/or the hardware and/or the frame portions, may be coated with an adhesion-promoting compound or primer, such as described in U.S. Pat. Nos. 7,360,338; 7,332,225; 6,871,450; 6,846,039; 6,319,344; 6,298,606; 6,128,860; 6,068,719; 5,966,874; 5,853,895; 5,704,173; and/or 5,551,197, which are hereby incorporated herein by reference in their entireties.

The frame portions and/or hardware elements thus may be readily adhered to or bonded to the glass panel, such as via a bead of adhesive or the like. Desirably, the adhesive may comprise a transparent adhesive, such as a transparent or substantially transparent epoxy or acrylate or the like. Optionally, the adhesive may comprise a UV curable adhesive, such as a UV curable acrylate or epoxy or a UV curable optically matching adhesive, such as the optical adhesives of the types commercially available from Norland Products of Cranbury, N.J., or other suitable transparent or substantially transparent adhesive. Such UV curable adhesives provide rapid curing or bonding of the glass panel to the hardware elements after the hardware elements are pressed against the surface of the panel with the adhesive therebetween. Optionally, and desirably, the adhesive may be selected to be at least partially to substantially space filling so that any tolerances or gaps between the mounting flanges and the glass panel are filled in or taken up by the adhesive. Optionally, beads, such as index matching beads, such as glass beads or fibers or polymeric beads or fibers or the like, may be provided so that the adhesive has an enhanced space filling function between the hardware and/or frame portions and the glass panel.

Thus, the transparent glass cover assembly of the present invention may consist of a piece of glass or glass panel that has a ceramic paint applied around its perimeter regions, with one or more (such as a pair of) hinge mounting brackets and a latch element mounted to or bonded to the inner surface of the glass panel. These components may be mounted to the glass utilizing a two component urethane adhesive and associated primers, as discussed above. The plastic or polymeric perimeter frame may be molded over the perimeter edge regions of the glass panel and/or may be bonded to the glass panel (and over and/or around the already bonded hardware or brackets), such as by utilizing a one component urethane adhesive and associated primers.

Changes and modifications to the specifically described embodiments can be carried out without departing from the principles of the present invention, which is intended to be limited only by the scope of the appended claims as interpreted according to the principles of patent law.

The embodiments of the invention in which an exclusive property or privilege is claimed are defined as follows:

1. A cover assembly for an appliance, said cover assembly comprising:

a glass panel having an outer surface and an inner surface and a perimeter region and a perimeter edge, said perimeter edge extending between said inner surface and said outer surface and along the periphery of said glass panel;

at least one metallic attachment element bonded to said inner surface of said glass panel via a layer of cured adhesive, wherein said at least one metallic attachment element is configured for mounting to a corresponding structure of the appliance to mount said cover assembly at the appliance;

wherein said layer of cured adhesive bonds said at least one metallic attachment element to said inner surface of said glass panel without exposure of said bonded metallic attachment element on said outer surface of said glass panel;

a perimeter frame established around said perimeter region of said glass panel; and wherein said perimeter frame encompasses said perimeter region of said inner surface of said glass panel and encompasses said perimeter edge of said glass panel, and wherein no portion of said outer surface of said glass panel is encompassed by said perimeter frame such that said outer surface of said glass panel is generally coplanar with an outer surface of said perimeter frame along said perimeter region of said glass panel.

2. The cover assembly of claim 1, wherein said perimeter frame is molded over and along said perimeter region of said glass panel.

3. The cover assembly of claim 1, wherein said perimeter frame is bonded via a second layer of cured adhesive to said inner surface of said glass panel and along said perimeter region of said glass panel.

4. The cover assembly of claim 3, wherein said perimeter frame comprises a polymeric material.

5. The cover assembly of claim 4, wherein said second layer of cured adhesive comprises a single component urethane adhesive.

6. The cover assembly of claim 1, further comprising an opaque coating established at said perimeter region of said glass panel.

7. The cover assembly of claim 1, further comprising an opaque coating established at said perimeter region of said glass panel and at least at the area at which said at least one metallic attachment element is bonded.

8. The cover assembly of claim 1, wherein said at least one metallic attachment element includes a plurality of protrusions extending from a generally planar portion of said at least one metallic attachment element to set a thickness of said layer of cured adhesive between said generally planar portion of said at least one metallic attachment element and said inner surface of said glass panel.

9. The cover assembly of claim 8, further comprising a ceramic frit layer established at least at a bracket mounting area at which said generally planar portion of, said at least one metallic attachment element is bonded.

10. The cover assembly of claim 9, wherein said layer of cured adhesive comprises a two component urethane adhesive having an isocyanate component and a polyol component.

11. The cover assembly of claim 10, wherein said at least one metallic attachment element is E-coated.

12. The cover assembly of claim 1, wherein said at least one metallic attachment element comprises at least one metallic hinge element configured for mounting to a hinge structure of the appliance to hingedly mount said cover assembly at the appliance.

13. The cover assembly of claim 12 further comprising a latch element bonded to said inner surface of said glass panel via a second layer of cured adhesive, and wherein said latch element is disposed at said perimeter region and is configured for engaging a corresponding latch of the appliance to retain said cover assembly in a closed position when said at least one metallic hinge attachment element is mounted to at least one hinge structure of the appliance to mount said cover assembly at the appliance.

14. A cover assembly for an appliance, said cover assembly comprising:

a glass panel having an outer surface and an inner surface and a perimeter edge extending between said inner surface and said outer surface and along the periphery of said glass panel;

a pair of metallic attachment elements bonded to said inner surface of said glass panel via a layer of cured adhesive, wherein said pair of metallic attachment elements are spaced apart along a perimeter region of said inner surface and are configured for mounting to a pair of corresponding structures of the appliance to mount said cover assembly at the appliance;

an opaque coating established at said perimeter region of said glass panel and at least at a bracket mounting area at which said pair of metallic attachment elements are bonded;

wherein said layer of cured adhesive bonds said pair of metallic attachment elements to said inner surface of said glass panel without exposure of said bonded metallic attachment elements on said outer surface of said glass panel; and a perimeter frame established around the periphery of said glass panel, wherein said perimeter frame is molded over and along said periphery of said glass panel; and wherein said perimeter frame encompasses said perimeter region of said inner surface of said glass panel and encompasses said perimeter edge of said glass panel, and wherein no portion of said outer surface of said glass panel is encompassed by said perimeter frame such that said outer surface of said glass panel is generally coplanar with an outer surface of said perimeter frame along the periphery of said glass panel.

15. The cover assembly of claim 14, wherein said layer of cured adhesive comprises a two component urethane adhesive.

16. The cover assembly of claim 14, wherein each of said pair of metallic attachment elements includes a plurality of protrusions extending from a generally planar portion of said metallic attachment element to set a thickness of said layer of cured adhesive between said generally planar portion of said metallic attachment element and said inner surface of said glass panel.

17. The cover assembly of claim 16, wherein an adhesion promoting primer is established at said bracket mounting area, and wherein said layer of cured adhesive comprises a two component urethane adhesive having an isocyanate component and a polyol component.

18. The cover assembly of claim 17, wherein said pair of metallic attachment elements are E-coated.

19. The cover assembly of claim 14, wherein said pair of metallic attachment elements comprises a pair of metallic hinge attachment elements spaced apart along a said perimeter region of said inner surface and are configured for mounting to a pair of hinge structures of the appliance to mount said cover assembly at the appliance.

20. The cover assembly of claim 19, further comprising a latch element bonded to said inner surface of said glass panel via a second layer of cured adhesive, wherein said latch element is disposed at an opposite perimeter region of said inner surface of said glass panel and is configured for engaging a corresponding latch of the appliance to retain said cover assembly in a closed position when said pair of metallic hinge attachment elements are mounted to hinge structures of the appliance to mount said cover assembly at the appliance.

* * * * *

UNITED STATES PATENT AND TRADEMARK OFFICE

CERTIFICATE OF CORRECTION

PATENT NO. : 8,276,409 B2
APPLICATION NO. : 12/917696
DATED : October 2, 2012
INVENTOR(S) : Troy F. Tooker It is certified that error appears in the above-identified patent and that said Letters Patent is hereby corrected as shown below:

Column 5
Line 8, "fit" should be --frit--
Line 25, "fit" should be --frit--, in both instances
Line 36, "fit" should be --frit--
Line 46, "fit" should be --frit--
Line 66, "fit" should be --frit--

Column 6
Line 3, "panel," should be --panel.--

Column 7
Line 39, "fit" should be --frit--

Column 9
Line 10, Claim 9, Delete "," after "of"

Column 10
Line 36, Claim 19, Delete "a" after "along"

Signed and Sealed this
Nineteenth Day of February, 2013

Teresa Stanek Rea
*Acting Director of the United States Patent and Trademark Office*